US005223160A

United States Patent [19]

Emmons

[11] Patent Number: 5,223,160

[45] Date of Patent: Jun. 29, 1993

[54] SULFUR DEPOSITION REDUCTION

[75] Inventor: Daniel H. Emmons, Rosenberg, Tex.

[73] Assignee: Nalco Chemical Company

[21] Appl. No.: 749,628

[22] Filed: Aug. 16, 1991

Related U.S. Application Data

[62] Division of Ser. No. 495,161, Mar. 19, 1990, abandoned.

[51] Int. Cl.[5] ..... C23F 11/02; C23F 11/173

[52] U.S. Cl. ..... 252/8.552; 507/90; 252/8.555; 252/391; 252/392; 422/9

[58] Field of Search ..... 507/90; 252/8.552, 8.555, 252/391, 392; 422/9

[56] References Cited

U.S. PATENT DOCUMENTS

| | | | |
|---|---|---|---|
| 3,029,265 | 4/1962 | Zech | 260/404.5 |
| 3,424,681 | 1/1969 | Stanford | 252/8.55 |
| 3,696,049 | 10/1972 | Hausler et al. | 252/392 |
| 3,705,109 | 12/1972 | Hausler et al. | 252/392 |
| 3,790,496 | 2/1974 | Hausler | 252/392 |
| 4,404,167 | 9/1983 | Rozenfeld et al. | 252/8.555 X |
| 4,900,458 | 2/1990 | Schroeder et al. | 252/8.555 |

*Primary Examiner*—Gary Geist
*Attorney, Agent, or Firm*—Bush, Moseley & Riddle

[57] ABSTRACT

The deposition of elemental sulfur in a conduit through which a sulfur containing gas is flowing is reduced by providing, as a novel sulfur dispersant, an ether alcohol component produced from primary alcohol and epichlorohydrin mixed with an aliphatic amine component, the dispersant being employed in the presence of liquid water. When the conduit is normally vulnerable to the corrosion caused by contact with the sulfur-containing gas, the sulfur dispersant is optionally employed in conjunction with a corrosion inhibitor.

8 Claims, No Drawings

SULFUR DEPOSITION REDUCTION

This invention is a division of patent application Ser. No. 07/495,161, filed Mar. 9, 1990, now abandoned.

FIELD OF THE INVENTION

This invention relates to an improved method of retarding the deposition of elemental sulfur during the passage of a sulfur-containing gas through a conduit. More particularly, the invention relates to the retardation of sulfur deposition and optionally to the additional reduction of metal corrosion during the reproduction, gathering and transporting of sulfur-containing natural gas.

BACKGROUND OF THE INVENTION

The presence of sulfur or sulfur-containing compounds in terrestrial depositions of hydrocarbon is well known and established. In the production of such hydrocarbon depositions which are normally liquid at the temperature and pressure of their production and transportation, the presence of such sulfur or sulfur compounds poses only a minimal difficulty, in a large part because of the solubility of these sulfur species and any elemental sulfur resulting therefrom in the liquid hydrocarbon moisture. A considerably different situation exists in the production of sour natural gas, i.e., natural gas containing hydrogen sulfide, because of the tendency of the sulfur species in the normally gaseous hydrocarbon to deposit as elemental sulfur in the conduits through which the sour natural gas is produced, gathered and transported. Such deposition is known to occur in the well string of a sour gas well and also in the wellhead and field gathering equipment. An extensive discussion of this problem is found in a paper tilted "Sulfur Deposition in Reservoirs and Production Equipment: Sources and Solutions," presented by Hyne et al to the 1980 Gas Conditioning Conference.

The source of the sulfur whose deposition is so detrimental in the production and processing of sour natural gas is possibly elemental sulfur found in the gas bearing formation and entrained in the natural gas but elemental sulfur may also result from oxidation of the hydrogen sulfide in the sour gas being produced and processed or from decomposition of hydrogen polysulfides. The deposition of elemental sulfur, if allowed to continue, would ultimately result in the plugging of the conduit through which the natural gas is being passed whether the conduit is the well string of the natural gas well or is a pipe or other equipment through which the sour gas is collected and transported to a processing plant. The detrimental effect of such plugging is readily apparent. Less apparent is an effect of sulfur deposition that takes place even without plugging or reduced gas flow. Unless special precautions have been taken, the presence of sulfur deposits may facilitate the corrosion of the walls of the conduit on which the sulfur has been deposited. In many sour gas wells, special metal alloys are employed for the well string which are selected to resist the corrosion normally encountered by carbon steels upon contact with aqueous solutions of sour gases. Such metal alloys are, however, quite expensive and are not often employed in wellhead and filed gathering equipment.

To decrease the possibility of sulfur deposition it has been proposed to provide sulfur solvents which will maintain any sulfur compounds or elemental sulfur formed in solution and thereby prevent the formation of sulfur deposits. A traditional solvent for hydrogen sulfide and other sulfur-containing species is monoethanolamine which is employed in numerous commercial process to "sweeten" sour gas. Solvent which remove the sulfur in the form of polysulfides are more efficient and dialkyl sulfides, particularly dimethyl sulfide, are employed and commercial mixtures such as that known as MEROX have been utilized for this purpose. The cost and availability of these solvents are substantial detriments to their use and generally result in the need to recover and recycle the solvent which adds substantially to the cost of the natural gas ultimately marketed. The use of carbon disulfide as a sulfur solvent would offer advantage because of a high sulfur capacity for the solvent. Carbon disulfide is both toxic and highly inflammable and its usage is substantially limited because of these and other factors.

The choice of a sulfur solvent is further influenced by the concentration of the sulfur-containing species in the sour gas. Physical solvents, i.e., those solvents which dissolve but do not react with the sulfur are suitable for the retardation of sulfur deposition where low or moderate sulfur deposition is expected. The use of a chemical/physical solvent which reacts with one or more of the sulfur species is required where a high degree of sulfur deposition is anticipated.

It has also been proposed to remove sulfur deposits as formed through the use of a "pig" or other scraping device. Such mechanical removal techniques are of reduced efficiency, however, when employed with conduits other than a straight pipeline.

With the higher price and reduced availability of natural gas in the geographical location of its usage, there is a greater need for the production of sour natural gas. It would be of advantage to reduce the likelihood of sulfur deposition during the passage of the sulfur species-containing gas through conduits of its production or processing and, optionally, additionally reduce the level of corrosion of such conduit resulting in part from the presence of sulfur deposits.

SUMMARY OF THE INVENTION

The present invention provides an improved process for retarding the deposition of elemental sulfur in a sulfur species-containing gas as it passes through conduits typically employed in the production and gather of a gas containing elemental sulfur or a precursor thereof. In an optional embodiment, the invention additionally serves to reduce the corrosion of internal conduit walls resulting in part from such sulfur deposition. Particular application of the invention is found in the production, gathering and transportation of a sour natural gas of relatively high hydrogen sulfide content.

DESCRIPTION OF THE INVENTION

The present invention comprises the use of a mixture of an alcohol ether component and an amine component in an aqueous solution, utilized in the presence of liquid water, as a sulfur dispersant. When this mixture is employed to contact a natural gas mixture containing hydrogen sulfide or other sulfur species and the inner surface of the conduit through which the natural gas mixture is passing, the deposition of elemental sulfur on the walls of the conduit is substantially reduced and in some instances is effectively eliminated. In situations where the sulfur-containing gas is normally corrosive to the inner surface of the conduit, the sulfur dispersant is optionally employed with a corrosion inhibitor mixture.

The term "natural gas" as employed herein is used to indicate a normally gaseous mixture of hydrocarbons, at least at ambient surface conditions of temperature and pressure, containing principally methane but also containing lesser amounts of carbon dioxide as well as other light hydrocarbons such as ethane, ethylene, propane and butane or even higher hydrocarbons. Such mixtures, although likely subsequently separated into methane and other components, are typically obtained as the initial product from a so-called "gas" well. The precise proportion of the mixture of the two or more carbon atoms is not critical, although the present invention finds particular application when the proportion of $C_5$ or higher hydrocarbons in the natural gas mixture does not exceed about 100% by volume. From commercial and economic standpoints the natural gas should contain at least about 20% by volume of methane, based on total gaseous mixture, and preferably at least about 50% by volume of methane on the same basis. The invention is usefully employed with natural gas mixtures containing as low as about 2% by volume of hydrogen sulfide, based on total gas mixture, or even lower amounts of hydrogen sulfide. However, the natural gas mixtures containing greater proportions of hydrogen sulfide pose the greater problems as a practical matter and the present invention is particularly usefully applied to natural gas mixtures containing from at least a 5% by volume based on total gas mixture of hydrogen sulfide up to about 90% by volume on the same basis or even higher.

The sulfur dispersant is a mixture of an alcohol ether component and an amine component. The alcohol ether is a chlorohydroxypropyl ether of a primary alcohol of certain carbon number produced by reaction of primary alcohol or mixture of primary alcohols with epichlorohydrin. Without wishing to be bound by any particular theory it appears probable that the primary alcohol reacts to open the oxirane ring of the epichlorohydrin and form a 3-chloro-2-hydroxypropyl ether of the primary alcohol. This ether, also containing an active hydroxyl group, is reactive towards additional epichlorohydrin to produce ethers of the primary alcohol of one or sequentially two or more chloropropyloxy moieties.

The primary alcohol precursor of the alcohol ether component is at least one primary alcohol of from about 6 to about 16 carbon atoms. In a large part because of economic reasons the alcohol precursor is preferably a mixture of primary alcohols of from about 6 to about 16 carbon atoms. Such alcohols are straight-chain or branched primary alcohols and individually are of even carbon number, of odd carbon number or are mixtures of odd and even carbon numbers. The preferred alcohol precursor is a mixture of straight-chain primary alkanols of both odd and even carbon number. The individual alcohols or mixtures thereof are commercially available from the commercial production of plasticizer or detergent range alcohols.

The primary alcohol or alcohol mixture is reacted with epichlorohydrin by conventional techniques, typically in the presence of a base such as an alkali metal or alkaline earth metal hydroxide, carbonate or bicarbonate. By control of reactant ratios and reaction condition as is known in the art it is possible to produce alcohol ethers of a variable ratio of alkanol and epichlorohydrin moieties. The alcohol ethers having an average of from 1 to about 3 moieties derived from epichlorohydrin for each moiety derived from the alcohol are suitable as a component of the sulfur dispersant mixture of the invention. Preferred alcohol ethers have an average of from about 1.5 to about 2.5 moieties derived from epichlorohydrin for each moiety derived from the alcohol.

The second component of the sulfur dispersant is an amine component containing at least a predominant amount of at least one aliphatic amine. Although an individual amine or a mixture of separate individual amines is useful as the amine component, a number of rather crude mixtures of aliphatic amines are commercially available as by-products of amine manufacture and contain a number of acyclic amines, primary, secondary or tertiary, and lesser proportion of aliphatic cyclic amines and aliphatic heterocyclic amines such as piperazines and pyrazines. Such mixtures are suitably employed when acyclic aliphatic amine content is at least about 40% by weight, based on total amine mixture. The acyclic aliphatic amines are usually alkyl amines such as those of the formula $R_xNH_{(3-x)}$ where R individually is alkyl of up to 8 carbon atoms inclusive, preferably lower alkyl of up to 4 carbon atoms inclusive, and x is an integer from 1 to 3 inclusive. Illustrative R groups are methyl, ethyl, isobutyl, hexyl and octyl and the alkyl amines are exemplified by trimethylamine, diethylamine, methyldipropylamine, tri-sec-butylamine, trioctylamine and dimethylethylamine. As stated, commercially available crude mixtures of amines are suitable wherein the precise proportion of any particular amine is not critical. Particularly useful and economically desirable is a mixture of acyclic, cyclic aliphatic and heterocyclic aliphatic amines independently of up to 24 carbon atoms inclusive wherein the acyclic amines comprise predominantly methyl amines including at least a major proportion of trimethylamines with no more than lesser proportions of dimethylamine and methylamine.

The sulfur dispersant mixture contains a first proportion of the alcohol ether component and a second proportion of the amine component. Dispersant mixtures containing from about 35% by weight to about 65% by weight of the amine component, based on total mixture, are satisfactory with the remainder of the dispersant mixture being the alcohol ether component. Dispersant mixtures containing from about 40% by weight to about 60% by weight on the same basis are preferred. The precise nature of any interaction taking place between the amine component and the alcohol ether component is not completely understood, but without wishing to be limited it is considered probable that reaction occurs between at least a portion of the amine component and at least a portion of the alcohol ether component to form quaternary ammonium salts at the carbon chlorine linkages of the alcohol ether component. Whatever interaction takes place occurs when the components are mixed and heated to an elevated temperature, e.g., 100° C., for a moderate time, for example, about 8 hours.

The sulfur dispersant mixture is supplied as an aqueous formulation containing from about 30% by weight to about 50% by weight, based on total solution, of water. Amounts of water from about 35% by weight to about 45% by weight on the same basis are preferred. In part to depress the pour point of the mixture and to provide freeze protection, the formulation suitably contains from about 10% by weight to about 30% by weight, based on total solutions, of a water miscible lower alkanol such as methanol, ethanol or isopropanol. The use of alkanol, particularly methanol, in a quantity from about 15% by weight to about 25% by weight on the same basis is preferred. In order to improve the dispersancy of the sulfur, the dispersant solution will also contain a surfactant, particularly a non-ionic surfactant. The precise nature of the non-ionic surfactant is not critical and conventional non-ionic surfactants such as detergent range alcohols, alcohol ethoxylates, polyethylene glycols, alkylphenols wherein the alkyl moiety is in the $C_6$ to $C_{18}$ range, long chain (fatty) amines, and fatty acid ethoxylates are satisfactory. The preferred class of non-ionic surfactants comprises the amines and acid ethoxylates, and particularly preferred are the acid ethoxylates. The surfactant is utilized in an amount of from about 10% by weight to about 20% by weight, based on total solution. The sulfur dispersant mixture (active material) is present in the dispersant solution in an amount of from about 15% by weight to about 35% by weight, based on total solution, but preferably is present in an amount of from about 20% by weight to about 30% by weight on the same basis.

The sulfur dispersant solution is utilized by contacting a hydrogen sulfide-containing gas and the internal surfaces of the conduit through which the gas is passing with the dispersant solution. The sulfur dispersant solution is introduced into the conduit together with or prior to the passage of the hydrogen sulfide-containing gas in order to protect the internal surfaces of the conduit from undue sulfur deposition. In the preferred modification of the process of the invention, the sulfur dispersant solution is used to retard sulfur deposition during the collection and transportation of the sour natural gas. In this modification the sulfur dispersant solution is introduced into the gathering equipment prior to, just as, or after the sour gas reaches the wellhead. The sulfur dispersant solution is also suitably introduced at a downhole location. The precise proportion of the sulfur dispersant solution to be utilized is not critical and proportions of the sulfur dispersant solutions in the natural gas from about 0.1 gallon per million cubic feet of sour natural gas (calculated at S.T.P.) to about 5 gallons per million cubic feet of sour gas are suitable. The preferred quantity of sulfur dispersant solution is from about 0.25 gallon to about 1 gallon per million cubic feet. The physical form of the sulfur dispersant solution upon contact with the sour natural gas is not entirely certain. A portion of the solution will likely be dissolved in or entrained in the flowing sour gas a second portion of the solution will likely "wet" or coat the internal surfaces of the conduit through which the gas is passing and a third portion will interact with the elemental sulfur to disperse it in the water present. It is necessary, however, for the success of the process of the present invention that liquid water be present, i.e., there must be sufficient water present during the contact of the sulfur dispersant solution and the sour natural gas to exceed the saturation concentration of water in the flowing natural gas. Some water is present, of course, in the sulfur dispersant solution and additional water vapor is present in many sour natural gases as produced. If, however, liquid water is not present when the sulfur dispersant solutions has contacted the flowing sour natural gas then additional water must be added. The precise amount of liquid water to be added is not critical so long as a meaningful quantity of liquid water is present. The addition of water is not required, of course, if liquid water is present upon the contacting of the sulfur dispersant solution and the flowing gas. If liquid water is not present upon such contacting, water should be added in a quantity of up to 500 gallons of liquid water per million cubic feet of sour natural gas (S.T.P.), more often up to about 200 gallons per million cubic feet of sour gas.

Application of the sulfur dispersant of the invention to the conduits through which sour natural gas is passing efficiently serves to reduce the deposition of elemental sulfur in such conduits. However, the passage of sour gas through conduits, particularly metallic conduits, serves to corrode such metallic conduits in the absence of special precautions such as the use of special corrosion resistant metals. The presence of even the reduced sulfur deposits encountered from time to time with the application of the sulfur dispersant of the invention poses a particular problem. In a special, although optional, embodiment of the invention the sulfur dispersant is employed in combination with a corrosion inhibitor to reduce the deposition of sulfur and the corrosion of the internal surfaces of a conduit through which a sour natural gas is passing, which corrosion includes that corrosion normally associated with the passage of sour natural gas through a metallic conduit.

The corrosion inhibitor which is preferably employed in conjunction with the sulfur dispersant of the invention, when inhibitor is employed, is a mixed organic acid amide of a polyethylenepolyamine component optionally but preferably employed in conjunction with a benzyl quaternary ammonium salt of a substituted pyridine compound.

The amide component of the corrosion inhibitor is derived by reaction with organic acid moiety of the polyamide with a polyethylenepolyamine of the general formula $$H_2N\{CH_2—CH_2—NH\}_yCH_2—CH_2—NH_2$$

wherein y is from about 4 to about 7 inclusive. It should be appreciated that y is an integer in the case of the individual polyethylenepolyamines of the above formula and the use of such individual polyethylenepolyamines is satisfactory. However, mixtures of such polyethylenepolyamines are also suitable and in such instances the term "y" will be an average number and not necessarily an integer. Such mixtures are commercially available as by-products of amine manufacture and are preferred as the precursor of the amide component of the optional corrosion inhibitor. The polyethylenepolyamine is converted to an amide salt by reaction with two types of acids. Although the desired amide could be suitably produced in a single step by reaction with a mixture of both types of acid, it is generally preferred to produce an amide in two reaction steps. In this modification the polyethylenepolyamine is reacted with tall oil fatty acid to produce a tall oil fatty acid partial amide. By tall oil fatty acid is meant a conventional mixture of primarily unsaturated $C_{18}$ acids. Such mixtures are commercially available and will typically include oleic acid as the primary constituent with lesser amounts of linoleic acid, conjugated and non-conjugated, and saturated fatty acids such as palmitic acid. A representative tall oil fatty acid mixture will contain about 40% by mole of oleic acid, based on total acid mixture, about 40% by mole linoleic acid on the same basis, with the remainder being primarily saturated fatty acids. To produce the tall oil fatty acid partial amide, sufficient tall oil fatty acid is provided to react with from about 25% to about 75% of the amino nitrogens present in the polyethylenepolyamine. Preferably, sufficient tall oil fatty acid is provided to react with from about 40% by mole to about 60% by mole of the amino nitrogens present in the polyethylenepolyamine. The reaction of the polyamine and the tall oil fatty acid is by conventional and well known procedures.

The tall oil fatty acid partial amide is then reacted further with at least one second acid type selected from saturated straight-chain carboxylic acids of from about 14 to about 26 carbon atoms inclusive or alkylbenzenesulfonic acids wherein the alkyl moiety has from about 8 to about 16 carbon atoms. Preferred among the second acids are octodecanoic acid and dodecylbenzenesulfonic acid. Sufficient second acid is provided to react with the partial amide so that at least about 90% and preferably at least about 99% of the amino nitrogens of the polyethylenepolyamine have reacted with acid to produce a corresponding amide salt. The reaction of second acid with the partial amide to produce amide salt is also by conventional methods. This type of amide salt mixture is broadly known and certain of these mixtures are commercially available being marketed under the VISCO trademark by Nalco Chemical Company.

The amide salt component of the corrosion inhibitor is usefully employed without additional active components when the corrosion inhibitor is used with the sulfur dispersant. However, in a generally preferred modification of the corrosion inhibitor the amide component is used in combination with a benzyl quaternary ammonium salt of at least one pyridine compound, particularly a substituted pyridine compound. A variety of pyridines are useful as precursors of the quaternary ammonium component of the optional corrosion inhibitor but preferred pyridines have up to 3 substitute groups of up to 8 carbon atoms inclusive selected from alkyl groups or alkenyl groups. Illustrative of such pyridine compounds are pyridine 2-picoline, 3-ethylpyridine, 3-ethyl-4-methylpyridine, 5-(2-butenyl)-2-picoline, 3,5-diethyl-2-picoline, 2-(1-propenyl)-5-ethylpyridine and 2,4,6-trimethylpyridine. Particularly preferred as the substituted pyridine compound are the picolines, particularly the 2-picolines. The substituted pyridines are suitably employed as single compounds or as mixtures of individual compounds. Such mixtures are available as by-products of heterocyclic amine production and are preferred, to a considerable extent, for economic reasons.

The benzyl quaternary ammonium salt of the pyridine compound is produced by known methods by reacting a benzyl halide compound, preferably a benzyl chloride compound, with the pyridine compound at an elevated temperature. The benzyl halide is otherwise unsubstituted, except with hydrogens, or contains additional substitutes such as alkyl or halo which are generally inert under the reaction conditions at which the benzyl halide compound reacts with the pyridine compound.

In the embodiment where the corrosion inhibitor contains both the amide salt component and the benzyl quaternary ammonium salt component the precise proportions of the two components is not critical. Ratios by weight of the amide salt component to the quaternary ammonium component up to about 3:1 satisfactory with ratios from about 1.5:1 to about 1:1.5 being preferred. The two components, when both components are employed, are mixed together by conventional methods and are generally employed as a hydrocarbon solution as is the amide salt component when only the amide salt component is to be utilized as the corrosion inhibitor. The hydrocarbon solvent for the corrosion inhibitor is aliphatic, aromatic or a mixture of aliphatic and aromatic hydrocarbons. The preferred hydrocarbon solvents are so-called heavy hydrocarbons having a boiling point above about 100° C. and preferably above about 130° C. Particularly preferred is a mixture of predominately aromatic naphtha.

The concentration of the corrosion inhibitor component or components in the hydrocarbon solvent should be at least about 25% by weight of the total solution and preferably at least about 45% by weight of the total solutions. In this solution also it is often desirable to include an alcohol such as methanol to depress the pour point and provide freeze protection. Certain of the corrosion inhibitors of this type are commercial, being marketed by Nalco Chemical Company under the trademark VISCO.

In the embodiment of the invention wherein corrosion inhibitor is employed in conjunction with the sulfur dispersant, the solutions containing the active materials are mixed by conventional methods and the resulting mixture is supplied as a liquid. In this embodiment, the weight ratio sulfur dispersant to corrosion inhibitor should not exceed 2 as the use of weight ratios higher than 2 will normally result in accelerated corrosion. Weight ratios of corrosion inhibitor to sulfur dispersant from about 0.5 to about 1.5 are preferred. When both sulfur dispersant an corrosion inhibitor are employed, the proportion of the sulfur dispersant to the gas being treated and the relative proportions of sulfur dispersant and corrosion inhibitor are as stated above.

The sulfur dispersant, optionally mixed with corrosion inhibitor, is employed to reduce sulfur deposition in conduits through which a hydrogen sulfide-containing gas is passing by contacting the gas and the internal walls of the conduit. When employed in a producing sour gas well, the composition(s) of the invention are pumped down the annulus between the well string and the wall of the well and are returned to the surface along with the sour gas or may be introduced via the drill string or at other locations. The provision of sulfur dispersant serves to retard plugging in the well string as well as in the well head and downstream gathering equipment. When the well string is constructed from material normally corroded by contact with sour natural gas, the presence of the corrosion inhibitor serves to reduce the corrosion normally encountered as well as that which may take place under any sulfur deposits which do occur. In instances where the well string is made from special corrosion resistant materials, the presence of the corrosion inhibitor is not required but is not detrimental.

In a somewhat different application, the sulfur dispersant is utilized to retard sulfur deposition in equipment for the gathering and transportation of the sour gas downstream from the wellhead. Such equipment is not often produced from specially corrosion resistant material and the use of a mixture of the sulfur dispersant and corrosion inhibitor is preferred to retard sulfur deposition as well as reduce corrosion. The use of the dispersant without corrosion inhibitor is satisfactory if the gathering and transportation conduits were not vulnerable to corrosion during passage of the sour natural gas.

It is an advantage of the present invention that the sulfur dispersant optionally employed with the corrosion inhibitor is typically employed on a once-through basis without the need for recovery or recycle of these compositions. Although recovery and recycle can be employed, the economic cost of the compositions of the invention is such that, upon separation from the natural gas during normal gas purification procedures, the sulfur dispersant and, if utilized, the corrosion inhibitor may be discarded without recovery and recycle.

The invention is further illustrated by the following Illustrative Embodiments which should not be construed as limiting.

Illustrative Embodiment I

A laboratory test was devised which would be readily conducted and evaluated an yet would be representative of conditions suitable for evaluating a number of additives as sulfur dispersant. The test was conducted by saturating a sample of brine with carbon dioxide for 30 minutes. A determined quantity of a candidate sulfur dispersant was added to a 250 ml flask and 250 ml of the saturated brine was then added. The contents of the flask were then stirred at 600 rpm and while stirring continued 0.2 ml of a mixture of hydrogen polysulfides was added. A preweighed metal coupon was inserted in to a cut in a stopper for the flask and the stopper was inserted into the flask so that the coupon was immersed in the brine solution. After three hours the stirring was discontinued and the stopper and coupon removed. The coupon was rinsed in isopropanol. dried and weighed. The increase in weight of the coupon was taken as the amount of sulfur deposited on the coupon during the test. The lower the weight gain, the better the performance of the candidate sulfur dispersant was considered to be. The results of these tests are shown in Table 1, wherein the candidate sulfur dispersant were the following:

A. The sodium salt of a $C_{11}$–$C_{12}$-olefin sulfonic acid.

B. An quaternary ammonium salt mixture produced by reacting the epichlorohydrin derivative of mixed $C_6$–$C_{10}$ primary alcohols (2 epichlorohydrin: 1 alcohol) with a crude mixture of alkyl and heterocyclic amines containing methyl amines, principally trimethylamine, as the major component.

C. A 2-methyl-2-acrylimidopropanesulfonic acid/acrylic acid copolymer.

D. A poly(sodium vinyl sulfonate).

TABLE 1

| Dispersant | Dispersant Concentration, ppm | Sulfur Deposit, mg |
|---|---|---|
| None (blank) | — | 72.7 |
| A | 1000 | 18.2 |
| B | 100 | 6.9 |
| B | 1000 | 5.5 |
| C | 1000 | 54.7 |
| D | 1000 | 57.0 |

Illustrative Embodiment II

Various ratios of sulfur dispersant and corrosion inhibitor were evaluated in a brine mixture similar to that likely to be encountered in a producing well. The sulfur dispersant was Candidate B of Illustrative Embodiment I and the corrosion inhibitor was mixture of an amide salt produced by reacting a polyethylenepolyamine mixture with sufficient tall oil fatty acid to concert about 50% of the polyamine to the amide and the amide converted to an amide salt by reaction with a mixture of dodecyclbenzenesulfonic acid and $C_{16-20}$ saturated carboxylic acid, and the benzyl chloride salt of pyindine.

A 100 ml sample of brine saturated with hydrogen sulfide and 100 ml of brine saturated with carbon dioxide were placed in a 200 ml test cell. Sufficient corrosion inhibitor was added to give a concentration of 1,000 ppm and varying concentrations of sulfur dispersant were also added. A sandblasted specimen of carbon steel rod of known weight was added and the test cell was sealed. The cell and contents were rotated on a mounting board for approximately 20 hours at 17 rpm and a temperature of 120° F. The steel was then removed, wiped dry and immersed in an inhibited hydrochloric acid solution for 2–5 minutes. The specimens were then cleaned with soap and steel wool, immersed in isopropyl alcohol and weighed. The weight loss in milligrams was recorded. The results are shown in Table 2.

TABLE 2

| Concentration of Dispersant | Wt. loss, mg. |
|---|---|
| 0 | 2.4 |
| 500 ppm | 3.1 |
| 1000 ppm | 3.1 |
| 2000 ppm | 4.8 |

Illustrative Example III

Various mixtures of the sulfur dispersant Candidate B of Illustrative Embodiment I and the corrosion inhibitor of Illustrative Embodiment II were evaluated in an active producing well. Seven test steel coupons were placed in the gathering apparatus just past the wellhead (1) and at a location downstream from the wellhead (6). The mixture of sulfur dispersant and corrosion inhibitor was introduced at the wellhead as a solution in water as the carrying agent. The temperature of the test environment was approximately 140° F. After the test period the coupon was removed and cleaned and dried as described in Illustrative Embodiment II. The weight loss was converted by mathematical calculation to diminished thickness of the coupon, measured in mils per year (mpy). The period for test I was 30 days and for test II was 29 days. In test I, the concentration of corrosion inhibitor was 2000 ppm and the concentration of sulfur dispersant was 1000 ppm. In test II, the concentrations were 1000 and 500. The results are shown in Table 3.

TABLE 3

| Test I | Measured Corrosion, mpy |
|---|---|
| Coupon 1 | 1.00 |
| Coupon 2 | 0.59 |
| Coupon 3 | 0.47 |
| Coupon 4 | 0.49 |
| Coupon 5 | 0.50 |
| Coupon 6 | 0.58 |
| Coupon 7 | 0.58 |

No visual evidence of sulfur deposition on the coupons was observed.

TABLE 3

| Test II | Measured Corrosion, mpy |
|---|---|
| Coupon 1 | 0.42 |
| Coupon 2 | 0.95 |
| Coupon 3 | 1.02 |
| Coupon 4 | 0.66 |
| Coupon 5 | 0.64 |
| Coupon 6 | 0.65 |
| Coupon 7 | 0.63 |

Some measure of sulfur deposition was visually observed.

I claim:

1. A method of reducing the deposition of elemental sulfur in a conduit through which sulfur-containing gas is flowing by contacting the gas and the internal surfaces of the conduit with a sulfur dispersant formulation consisting essentially of:

a. from about 30% by weight to about 50% by weight, based on the total formulation, of water, b. from about 10% by weight to about 30% by weight, based on the total formulation, of lower alcohol selected from the group consisting of methanol, ethanol and isopropanol, c. from about 10% by weight to about 20% by weight, based on the total formulation, of non-ionic surfactant selected from the group consisting of detergent range alcohols, alcohol ethoxylates, polyethylene glycols, alkylphenols wherein the alkyl moiety is in the $C_6$ to $C_{18}$ range, long chain fatty amines and fatty acid, ethoxylates and d. from about 15 % by weight to about 35% by weight, based on the total formulation, of the sulfur dispersing composition consisting essentially of a mixture of a chlorohydroxyphenyl ether of a primary alcohol of from about 6 to 16 carbon atoms and at least one aliphatic amine selected from the group consisting of acyclic amines of the formula $R_xNH_{(3-x)}$ wherein R individually is alkyl of up to 8 carbon atoms inclusive, cyclic amines and heterocyclic amines.

2. The method of claim 1 wherein the aliphatic amine comprises at least about 40% by weight of aliphatic acyclic amines.

3. The method of claim 1 wherein the ether component is derived from epichlorohydrin and at least one primary alcohol having from 1 to 3 moieties derived from dry epichlorohydrin per moiety derived from primary alcohol, and the amine component comprises at least a major portion of trimethylamine, the ether constituting from about 35% by weight to about 65% by weight of the mixture.

4. The method of claim 1 wherein the lower alkanol is methanol and the non-ion surfactant is fatty amine or fatty acid ethoxylate.

5. A method of reducing the deposition of elemental sulfur and reducing the corrosion normally caused by contact with a sulfur-containing gas in a conduit in which the sulfur-containing gas if flowing by contacting the gas and the internal walls of the conduit with the sulfur dispersant formulation of claim 1 and corrosion inhibitor formulation in an amount up to twice the weight of the sulfur dispersant formulation, said corrosion inhibitor formulation consisting essentially of hydrocarbon solvent and from about 25% by weight to about 35% by weight based on total corrosion inhibitor formulation of:

a. the amide salt components produced by reaction of polyethylenepolyamine with tall oil fatty acid and the amide resulting therefrom with acid selected from the group consisting of straight-chain carboxylic acid of from about 14 to about 26 carbon atoms and alkylbenzenesulfonic acid wherein the alkyl has from about 8 to about 16 carbon atoms, with b. up to one-third the weight of amide salt component of a benzyl quaternary ammonium salt of at least one pyridine compound.

6. The method of claim 5 wherein the amide is produced by reaction of the polyethylenepolyamine of the formula $$H_2N\{CH_2—CH_2—NH\}_yCH_2—CH_2—NH_2$$

wherein y is from about 4 to about 7 inclusive with sufficient tall oil fatty acid to convert from about 40% to about 60% of the amino nitrogen atoms to amide moieties.

7. The method of claim 6 wherein the ratio by weight of the amide salt to the benzyl ammonium salt is from about 1.5:1 to about 1:1.5.

8. The method of claim 7 wherein the hydrocarbon solvent is heavy hydrocarbon having a boiling point above about 100° C.

* * * * *

UNITED STATES PATENT AND TRADEMARK OFFICE

CERTIFICATE OF CORRECTION

PATENT NO. : 5,223,160

DATED : June 29, 1993

INVENTOR(S) : Daniel H. Emmons

It is certified that error appears in the above-identified patent and that said Letters Patent is hereby corrected as shown below:

Column 11, line 36, after "to" insert -- about --.

Column 12, line 7, "if" should be -- is --.

Signed and Sealed this

Eighth Day of February, 1994

Bruce Lehman

*Attest:*

BRUCE LEHMAN

*Attesting Officer*

*Commissioner of Patents and Trademarks*